US007020406B2

(12) United States Patent
Swantner

(10) Patent No.: US 7,020,406 B2
(45) Date of Patent: Mar. 28, 2006

(54) PRINTING DEVICE

(75) Inventor: Richard L. Swantner, Bois, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 145 days.

(21) Appl. No.: 10/769,524

(22) Filed: Jan. 30, 2004

(65) Prior Publication Data

US 2005/0169652 A1 Aug. 4, 2005

(51) Int. Cl.
*G03G 15/06* (2006.01)

(52) U.S. Cl. ..... 399/53; 399/55

(58) Field of Classification Search ..... 399/55, 399/53, 49
See application file for complete search history.

(56) References Cited

U.S. PATENT DOCUMENTS 5,313,252 A * 5/1994 Castelli et al. ..... 399/49

* cited by examiner

*Primary Examiner*—Susan Lee

(57) ABSTRACT

A printing device can determine a toner development control parameter. The printing device can receive a print job that describes an image to be printed. The printing device can determine if a band of image lines in the image satisfies pre-determined criteria. The printing device can determine a development control parameter value based, at least in part, on whether the band is determined to satisfy the pre-determined criteria.

23 Claims, 9 Drawing Sheets

PRINTING DEVICE

BACKGROUND OF THE INVENTION

It is noted that the phrase "printing device" as used in this document will be understood to include any device that provides a printing function. Thus the phrase "printing device" may, for example, refer to a multi-function device that includes a printing function as well as additional functions. Such additional functions may include, without limitation, one or more of the following: faxing, copying, scanning and the like. The phrase "laser printing device", as used in this document, refers to any printing device that may employ an electrophotographic process to perform a printing function.

The electrophotographic process typically involves irradiating a photoconductor so as to form an electrostatic latent image on the photoconductor. Toner may then be transferred, by use of a developer apparatus, to the photoconductor so as to develop the latent image.

Once the latent image is developed, it may then be transferred to a media. In some laser printing devices, the latent image is directly transferred from the photoconductor to the print media. In others, the transfer of the latent image to the print media is via an intermediate transfer mechanism (e.g., an intermediate transfer belt).

Problems may occur if an improper amount of toner is presented to the photoconductor during latent image development. Presenting an excessive amount of toner to the photoconductor, for example, may over develop some areas of the latent image and thereby cause print quality defects. Additionally, some of the excess toner may become airborne and deposit, in an uncontrolled manner, onto various surfaces within the printing device. Airborne toner particles, for example, that deposit onto unintended areas of the photoconductor may negatively impact print quality. Airborne toner particles that deposit onto electrical or optical elements of a laser printing device may also negatively impact print quality as well as device reliability.

In addition, presenting an excessive amount of toner to the photoconductor can also be associated with charging the toner and agitating a toner supply more than what is necessary. This can accelerate the degradation of the toner properties and cause what is sometimes referred to as "toner wear". Toner wear can negatively impact both print quality and device reliability.

DRAWING DESCRIPTION

DESCRIPTION

Figure 1:
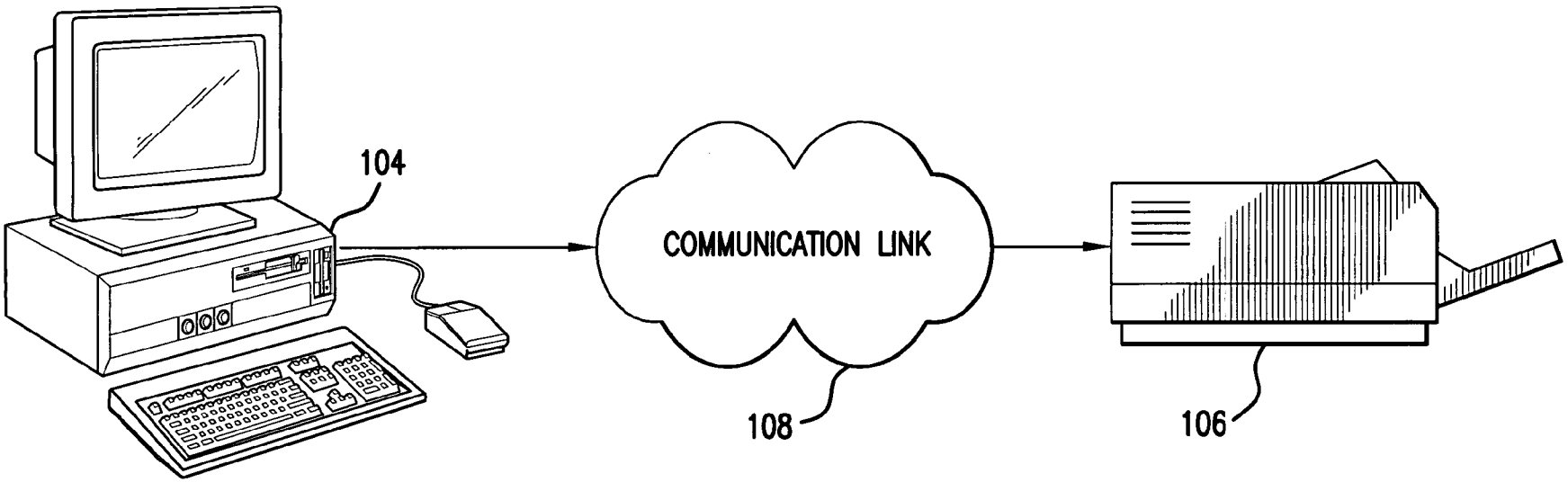
FIG. 1 is a block diagram of a printing device according to one embodiment of the invention.

FIG. 1 illustrates a printing system 102 that incorporates one embodiment, among others, of the invention. As shown, the printing system 102 includes a user computer 104 connected to a printing device 106 via a communication link 108.

The user computer 104 may represent any type of computer that can transmit or cause a print job to be transmitted to the printing device 106. The communication link 108 may represent any type of communication path that can enable the user computer 104 to transmit a print job to the printing device 106. Thus, for example, the communication link 108 may represent a cable, a wireless communication path, a network system, and/or the public INTERNET, etc.

The printing device 106 may represent any type of laser printing device. Thus, for example, the printing device 106 may represent a laser printing device suitable for use in a home or business environment. In other examples, the printing device 106 may represent a commercial digital printing press that employs an electrophotographic process to print on media.

It is further noted that the printing device 106 may provide more than a printing function. For example, the printing device 106 may allow a walk-up user to scan hard copy documents, make copies of the scanned document, etc.

Components of the Exemplary Printing Device

Figure 2:
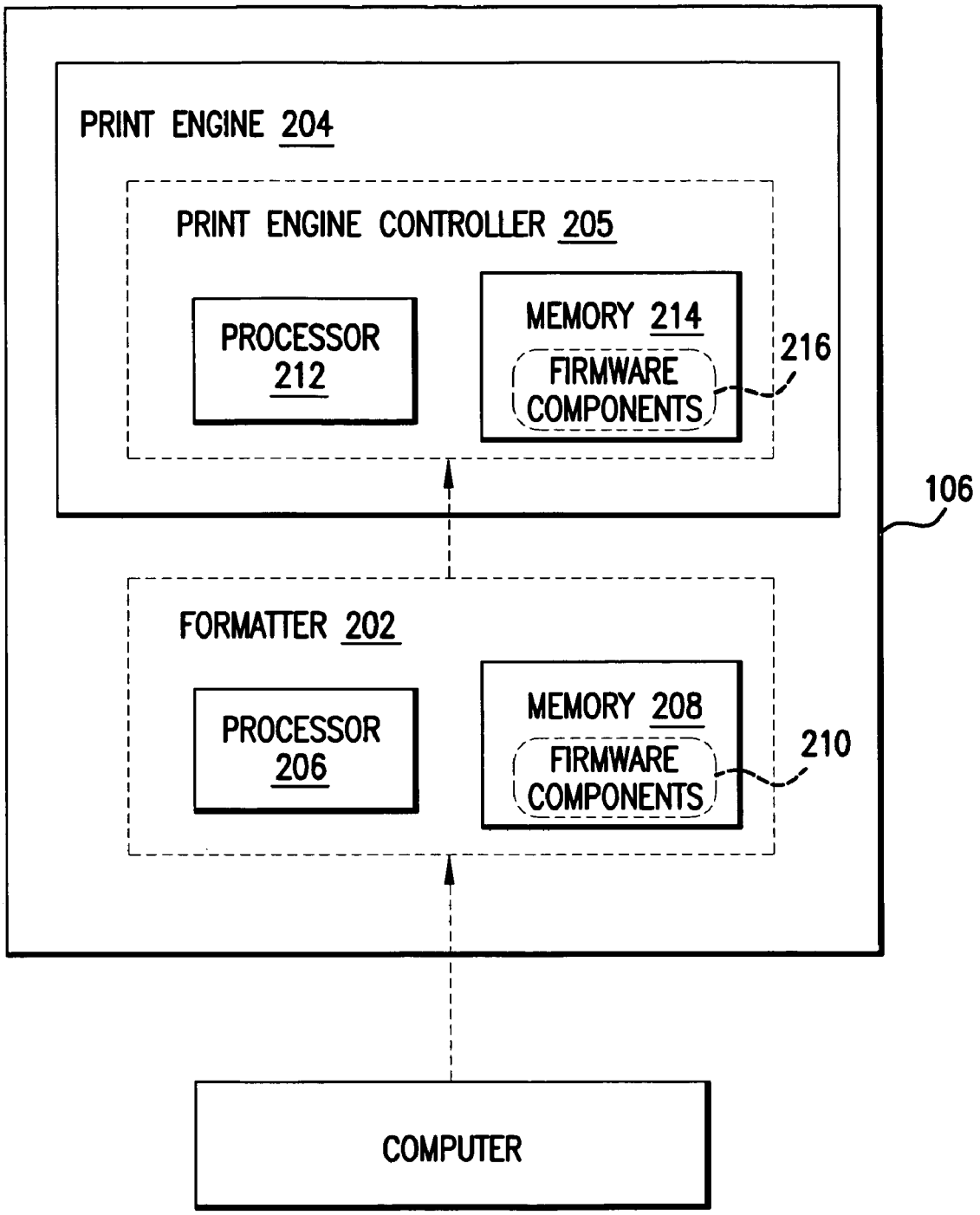
FIG. 2 is a high-level block diagram showing some of the components of the printing device.

FIG. 2 is a high-level block diagram showing some of the components of the printing device 106.

As shown, the printing device 106 includes a control and formatter system (formatter) 202 and a print engine 204 that includes a print engine controller 205. The formatter 202 includes a processor 206 and a memory 208. The memory 208 stores various firmware components 210 that can be executed by the formatter processor 206.

The print engine controller 205 also includes a processor 212 and a memory 214 that stores various firmware components 216 that can be executed by the engine controller processor 212.

It is to be understood that the printing device 106 may include any number of other components and/or subsystems that are not shown in the figures. For example, the printing device 106 may include a hard-drive, a local user interface, a page scanner, etc.

In general, the formatter 202 controls the general operation of the printing device 106. In addition, the formatter 202 can function to process a print job received from an external computer (e.g., the computer 104) into video data that is transmitted to the print engine controller 205. The print engine controller 205 receives the video data and functions to control the print engine to print the job.

Further aspects of the formatter 202 and the print engine controller 205 functionality are described in greater detail below.

Construction of the Exemplary Print Engine

Figure 3:
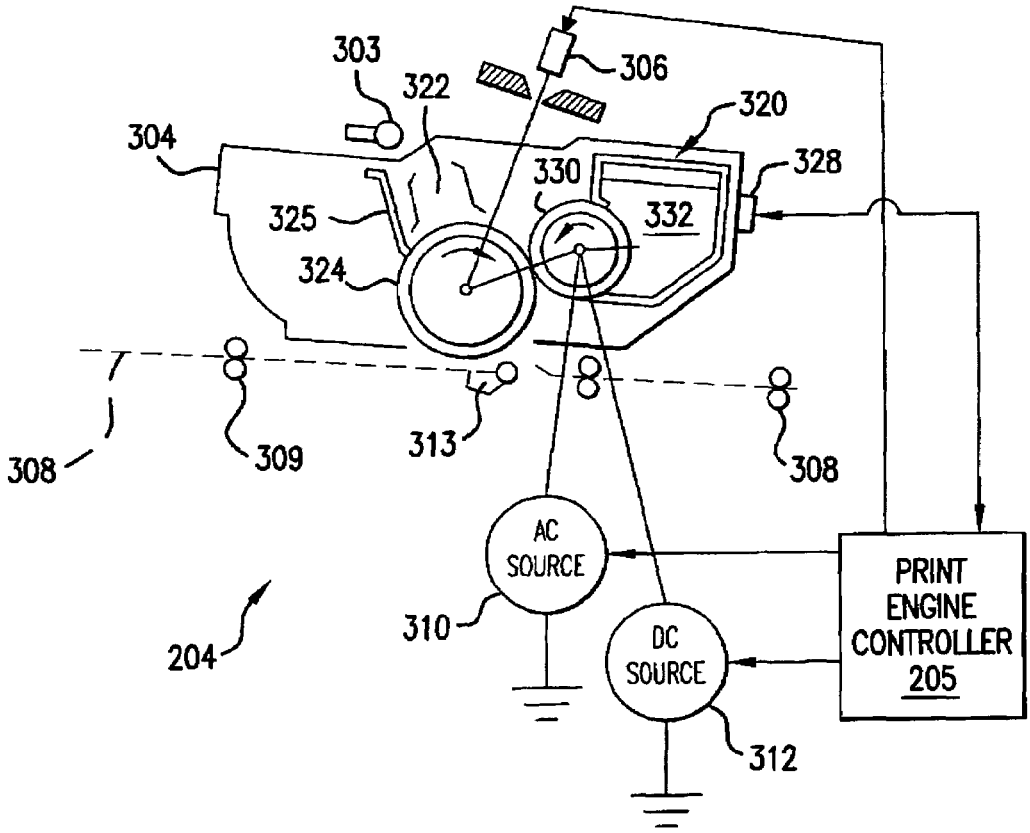
FIG. 3 is a block diagram illustrating one example of how a print engine may be constructed according to one embodiment of the invention.

FIG. 3 is a high-level block diagram illustrating one example of how the print engine 204 may be constructed. As shown, the print engine 204 includes the print engine controller 205 and various other components to implement the electrophotographic process. These other components may include, for example, the following: a discharge lamp 303, a replaceable toner cartridge 304, a laser scanning unit 306, a media transport system 308, a fusing station 309, an alternating current (AC) source 310, a direct current (DC) source 312, and a media corona wire 313.

In this embodiment, the toner cartridge 304 includes a toner developer mechanism 320, a drum corona wire 322, a photoconductive drum 324, a cleaning blade 325 and a cartridge memory 328.

It is noted that, in this embodiment, the cartridge memory 328 is an integrated part of the replaceable toner cartridge 304. When the toner cartridge 304 is installed into the printing device 106, the print engine controller 205 can access the memory 328. In some specific implementations, the engine controller can access the cartridge memory via a wireless communication link. In other implementations, the engine controller can access the cartridge memory over a physical connection that is temporarily established when the print cartridge is installed in the printing device.

In this embodiment, the cartridge memory 328 stores a look-up table. The purpose of the look-up table is described further below.

The developer mechanism 320 includes a developer roller 330 and a toner supply 332. While the toner cartridge 304 is installed in the printing device, the outer surface of the developer roller 330 is in electrical contact with the AC source 310 and the DC source 312.

It is noted that in other embodiments of the invention, the print engine 204 may include additional components and/or components that are differently configured. The following list illustrate some non-limiting examples of print engine variations according to other embodiments of the invention:

1. The photoconductor is configured as a belt that also serves to provide media transportation;

2. The print engine includes one or more offset rollers that are used to transfer a developed image from the photoconductor to a media;

3. The print engine has access to more than one supply of toner (e.g., one or more supplies of differently color toner); and/or 4. The developer mechanism is a permanent or semi-permanent part of the printing device (as opposed to being integrated into a replaceable print cartridge).

General Operation

As noted above, the print engine 204 employs an electrophotographic process to perform a printing function. In general, one cycle of the electrophotographic process employed by the print engine 204 may be described in terms of the following series of steps:

Photoconductive Drum Charging Step: At this step, the drum corona wire 322 is used to apply a charge to the surface of the photoconductive drum 324;

Exposure Step: At this step, the laser scanning unit 306 is used to scan, one "scan line" at time, a laser beam across the surface of the photoconductive drum 324. The laser beam is modulated during each scan as dictated by the video data produced by the formatter 202. This results in the drum surface being exposed at locations that are intended to receive toner. As understood by those skilled in the art, this results in an electrostatic latent image (comprised of scan lines) being formed on the surface of the photoconductive drum 324.

For ease of the later discussion, a line in an image that corresponds to a scan line on the surface of a photoconductor may be referred to herein as an "image line".

Development Step: At this step, toner is transferred from the toner supply 332 to the surface of the photoconductive drum 324 so as to develop the electrostatic latent image.

The transfer of toner is achieved, in the present embodiment, by rotating the developer roller 330 while applying both an AC bias (via the AC source 310) and a DC bias (via the DC source 312) to the outer surface of the developer roller 330. The toner is electrostatically charged in the toner supply 332 and the electrostatic potential difference between the toner and the developer roller 330 cause toner in the toner supply 332 to collect onto the outer surface of the developer roller 330. Then the DC bias and the AC bias applied to the developer roller 330 and the electrostatic potential difference between the developer roller and the photoconductive drum 324 cause the toner to "jump" to the surface of the photoconductive drum 324 so as to develop the latent image.

Transfer Step: At this step, the media corona wire 313 is used to charge the back side of a media that is properly positioned by the media transport system 308. This causes the developed latent image to transfer from the photoconductive drum 324 to the media.

Fusing Step: At this step, the media transport system 308 transports the media to the fusing station 309 that is used to fuse the image to the media. This results in the image being bonded to the media.

Cleaning/Discharge Step: At this step, the cleaning blade 325 is used to clean the outer surface of the photoconductive drum 324. Additionally, the discharge lamp 303 is used to discharge the photoconductive drum 324.

The steps just described may be repeated as needed so as to print the desired image. In other embodiments of the invention, variations of the electrophotographic process just described may be employed.

Development Control Parameters

It is noted for the later discussion that the print engine 204 has a number of control parameters values that are set and controlled by the engine controller 205 during the electrophotographic process. For ease of discussion, a control parameter value that can be set and/or controlled during the development step may be referred to herein as a "development control parameter".

For example, during the development step, the engine controller 205 can control the magnitude of the AC and DC bias that are applied to the surface of the developer roller 330. The engine controller can also control the frequency and waveform of the AC bias. The magnitude of these currents, for example, affects the amount of toner that is presented by the developer roller 330 to the photoconductive drum 324. The engine controller 205 determines the speed of motors contained in the print engine 204 and is able to vary the speed of the developer roller 330.

The magnitude of the AC bias, the frequency and waveform of the AC bias, the magnitude of the DC bias, each represent an example of a "development control parameter". Other examples may include the rotational velocity of the developer roller 330.

Operation of Formatter

Figure 4:
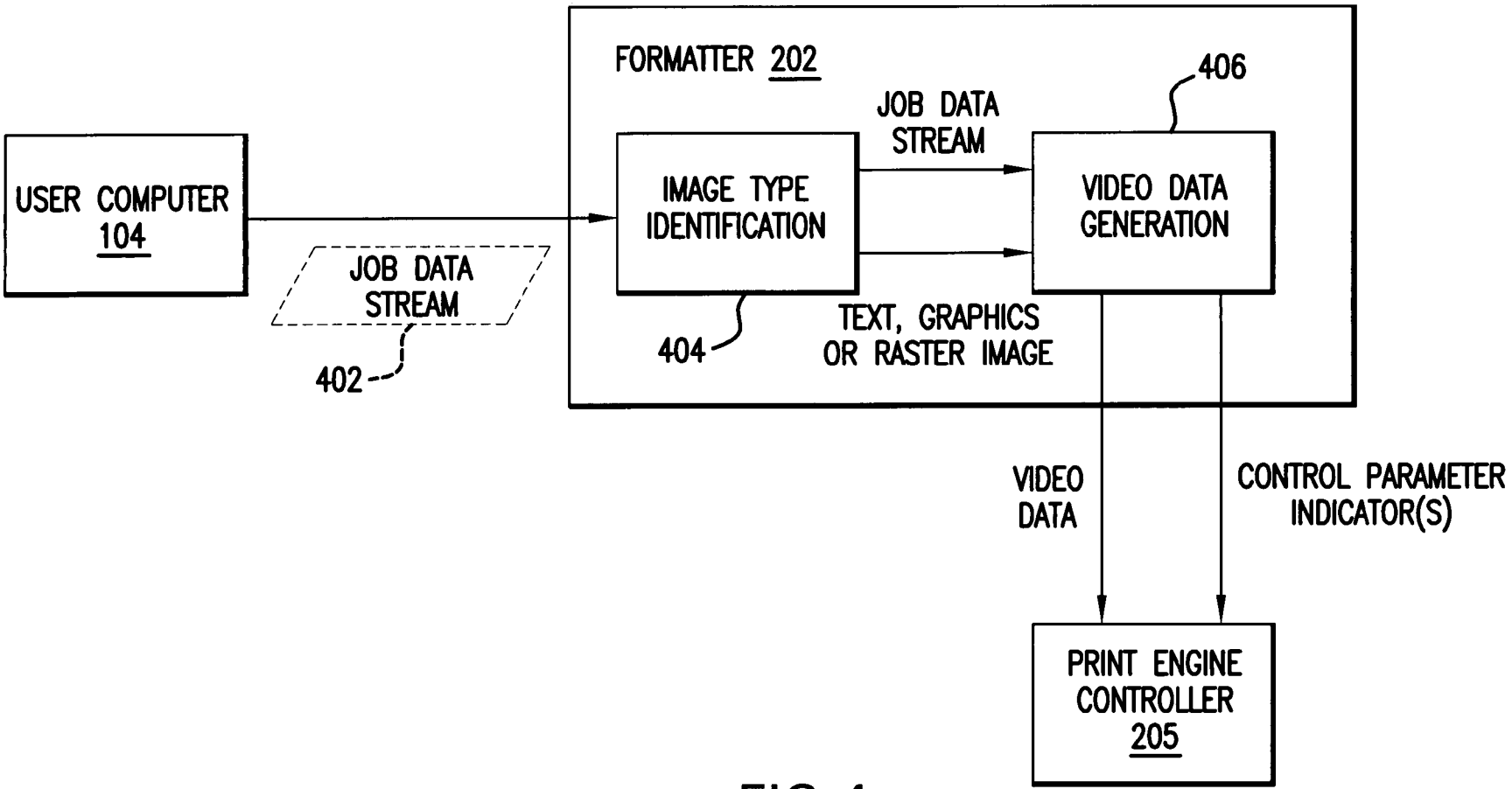
FIG. 4 is a block diagram for illustrating certain aspects of the functionality of a formatter according to an embodiment of the invention.

Shown in FIG. 4 is a block diagram for illustrating, from a conceptual standpoint, certain aspects of the formatter 202 functionality in response to a print job 402 being received (in the form of a data stream) from the user computer 104. The print job 402 describes an image to be printed (e.g., a single or multi-page document).

As shown, the formatter 202 includes an image type identification module 404. The image type identification module 404 operates, in the present embodiment, to classify elements of the image described by the print job 402 as "Text", "Graphics" or "Raster".

In this embodiment, for example, the image elements that are classified in this manner are the individual pixels in the image that require toner development. These pixels correspond to the non-background pixels described by the job. Thus, for example, the image type identification module 404 may classify each non-background pixel as "Text", "Graphics" or "Raster".

Assume, for example, that portions of the image data included in the print job 402 is formatted in a version of the Printer Control language (PCL). The image type identification module 404 may operate to classify any non-background pixel that is derived from these data portions as "Text". Secondly, assume that other portions of the print job 402 is formatted in a graphics language (e.g., HP/GL). The image type identification module 404 may operate to classify any non-background pixel that is derived from these data portions as "Graphics".

Thirdly, assume that still other portions of the print job 402 is raster data. The image type identification module 404 may operate to classify any non-background pixel that is derived from these data portions as "Raster".

The formatter 202 further includes a video data generation module 406. The video data generation module 406 operates to both process the print job 402 into video data and to transmit this video data to the print engine controller 205. The video data that is generated by the formatter 202 is in an "engine ready" form, suitable to be processed by the print engine controller 205.

Additionally, the video data generation module 406 operates to use the image type classification information to generate a group of indicators that are also transmitted to the print engine controller 205. For ease of the following discussion, these indicators may be referred to herein as "development control parameter" (DCP) indicators.

Figure 5:
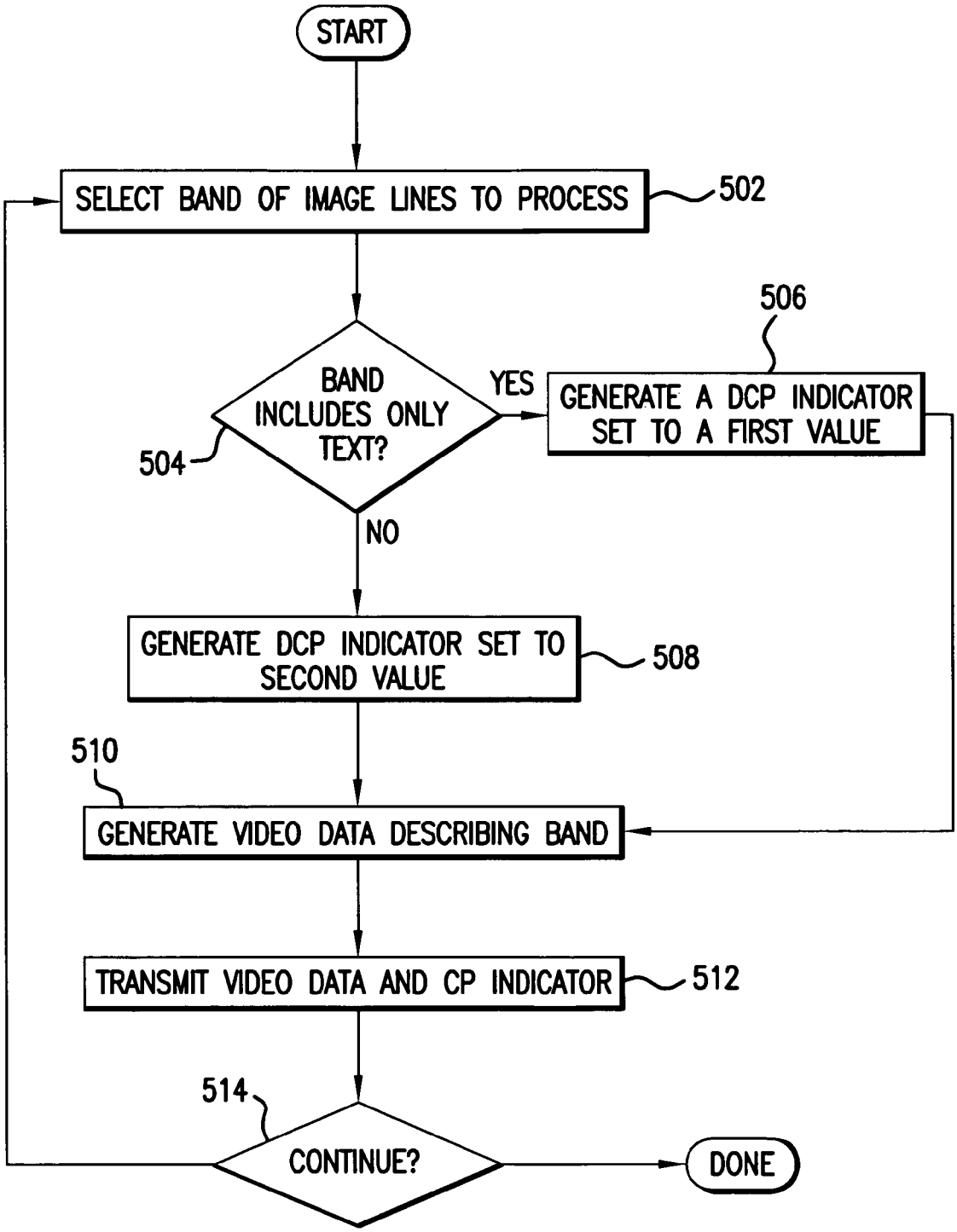
FIG. 5 is a flow diagram for illustrating generally how the formatter may operate to process a print job.

FIG. 5 is a flow diagram for illustrating generally how the formatter 202 may operate to process the print job 402 into video data and to generate the DCP indicators.

Referring to FIG. 5, the formatter 202 selects a first band of image lines described in the print job 402 to process (block 502). At block 504, the formatter 202 determines whether the selected band satisfy certain criteria. In this example, the criteria is satisfied if one of the following two conditions exist:

Condition #1: The selected band does not contain pixels that require development (i.e., the selected band contains only background pixels); or Condition #2: The selected band does contain pixels that require development and those pixels are all classified as "Text".

If the criteria is determined to be satisfied, the formatter 202 generates a DCP indicator that is set to a first value (block 504, block 506). If not, the formatter 202 generates a DCP indicator that is set to a second value (block 504, 508).

Thus, for example, if the currently selected band of image lines contains pixels that are classified as Text and pixels that are classified as Graphics or Raster, then the DCP indicator is set to the second value. If, however, the selected band of image lines contains only pixels that are classified as Text, then the DCP indicator is set to the first value.

At block 510, the formatter 202 operates to generate video data. The video data describes the selected band of image lines and can be used to modulate the laser scanning unit 306 to create a corresponding band of scan lines on the surface of the photoconductor 324.

At block 512 the video data generated at block 510 and the DCP indicator is transmitted to the print engine controller 205.

At block 514, the formatter 202 decides to process the next band of image lines described by the print job in a similar manner just described. The formatter 202 continues in this manner until the print job 402 is completely processed.

Figure 6:
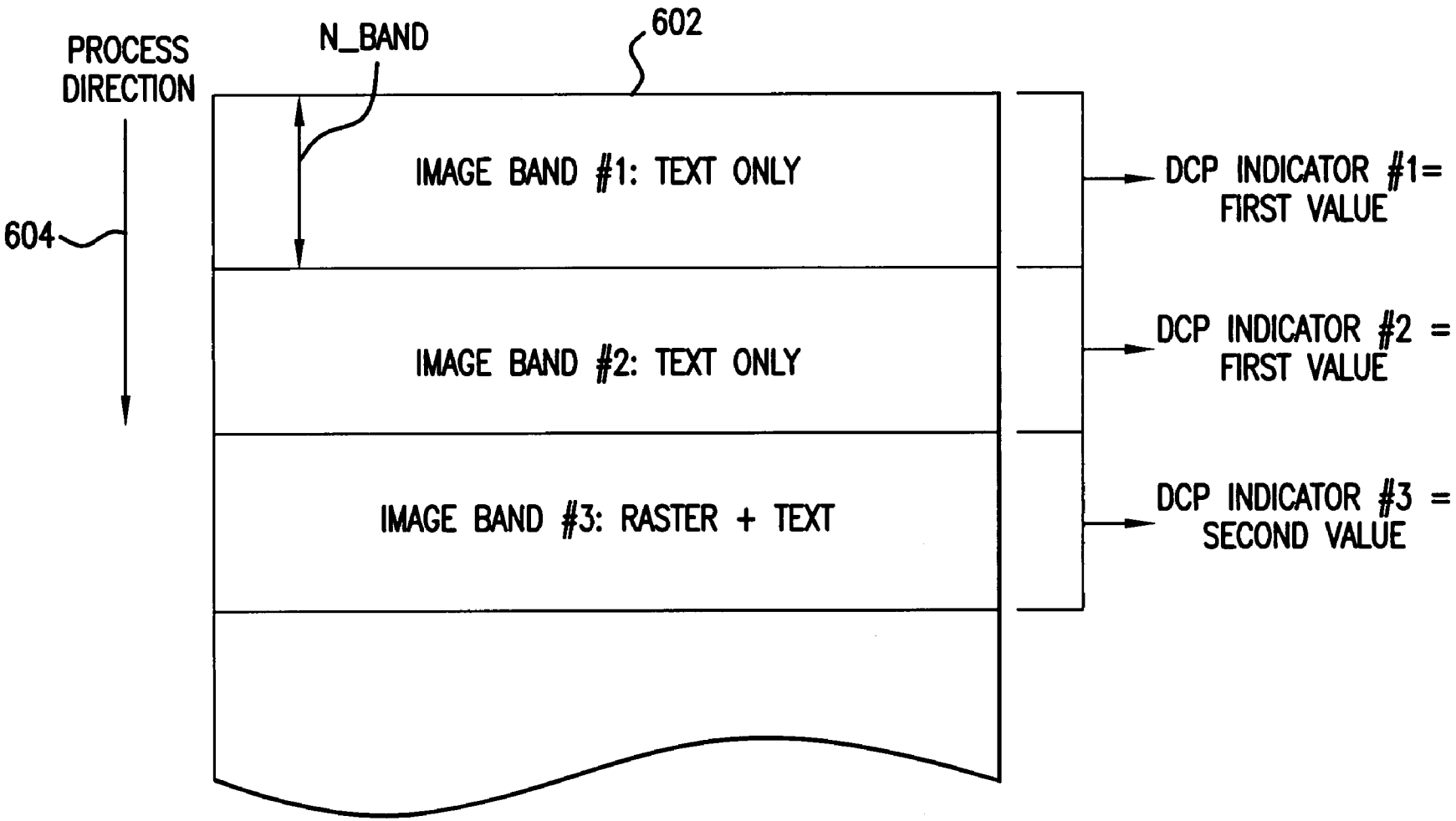
FIG. 6 illustrates further how the formatter may process the print job.

FIG. 6 illustrates further the process of FIG. 5. For illustration purposes, it is assumed that the print job 402 describes a multi-page color document and the image shown (i.e., image 602) represents one color image plane of the very first page in the document.

As indicated by process direction arrow 604, the formatter 202 generates a DCP indicator first for the first band of image lines (image band #1), followed by the second band of image lines (image band #2) and then followed by the third band of image lines (image band #3) and so on. In this embodiment, the number of image lines in each of the image bands is a fixed number ("N_band"). It is noted that the value of "N_band" may be significantly less than the maximum number of lines that can be can be formed on the photoconductive drum 324. In some implementations, for example, the width of each image band, in terms of a scalar dimension, may be selected from a range of about 0.1 to 2 inches.

As indicated in the figure, image band #1 and image band #2 is determined to include only "Text". Thus, the DCP indicator generated for each of these two image segments is set to the first value.

Image band #3, however, contains a combination of "Raster" as well as "Text". Thus, the DCP indicator generated for image band #3 is set to the second value.

Print Cartridge Memory Look-Up Table

As noted above, the print cartridge 304 includes a memory 328 that stores a look-up table. The look-up table, in this embodiment, relates each defined DCP indicator value to a developer control parameter value. In this embodiment, the look-up table relates each DCP indicator value to an AC bias value. Table 1 illustrates these relationships.

TABLE 1

| DCP Indicator Value | AC Bias Value | Comments |
|---|---|---|
| First Value | I(1) Amps | I(1) selected to optimize for Text development |
| Second Value | I(2) Amps | I(2) selected to optimize for Raster or Graphic type images development |

As noted in table 1,the value of "I(1)" can be selected to optimize for the development of latent image segments that contain only Text. The value of "I(2)" can be selected to optimize for the development of latent image segments that contain Graphics and/or Raster images.

It is also noted the AC bias values may take into account the individual characteristics of the print cartridge itself. Thus, the AC bias values shown in table 1 may be "tuned" specifically to account for the individual characteristics of the print cartridge 304. This represents one advantage of storing the look-up table in a memory that is an integrated part of the print cartridge. It should be noted, however, that in other embodiments a look-up table may be stored in a memory that is a permanent part of the printing device. This memory, for example, may be a part of the formatter, the print engine controller, etc.

Operation of the Engine Controller

Figure 7:
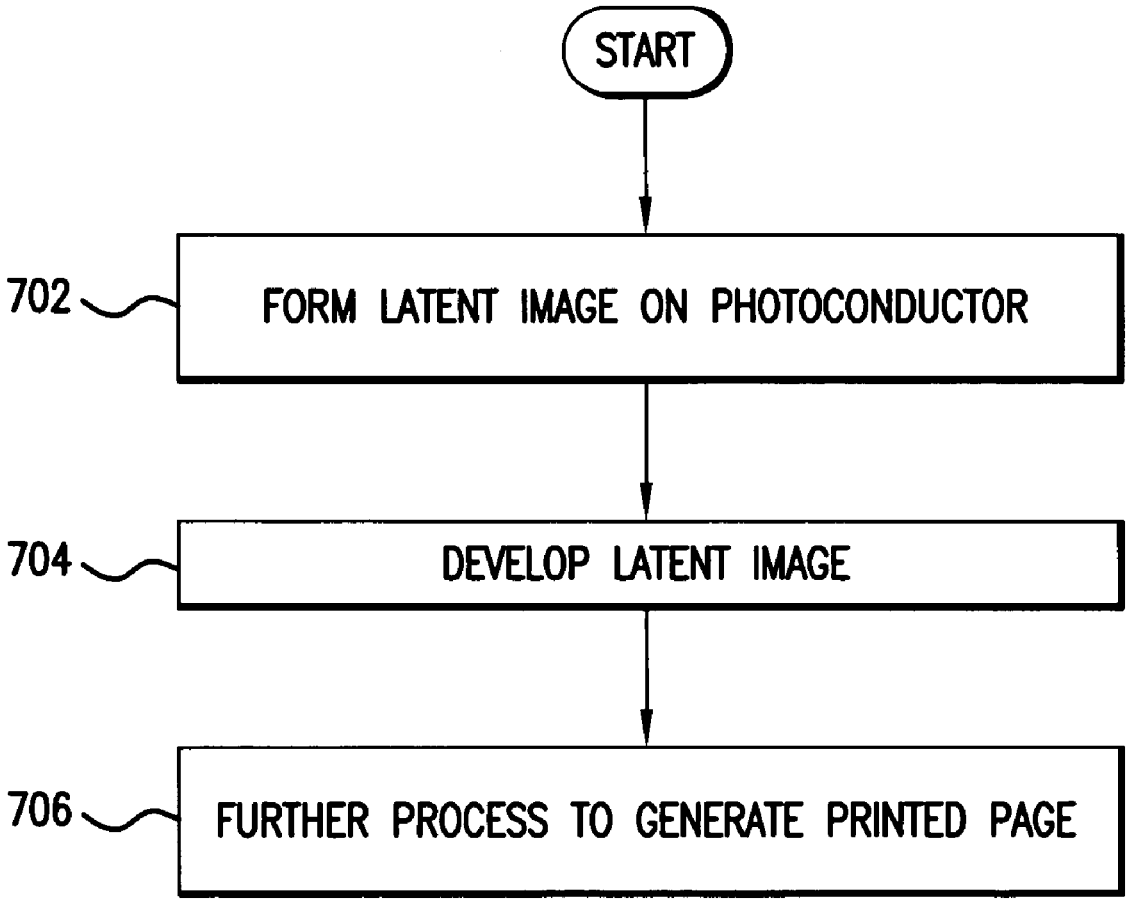
FIG. 7 is a flow diagram for illustrating the operation of a print engine controller according to one embodiment of the invention.
Figure 8:
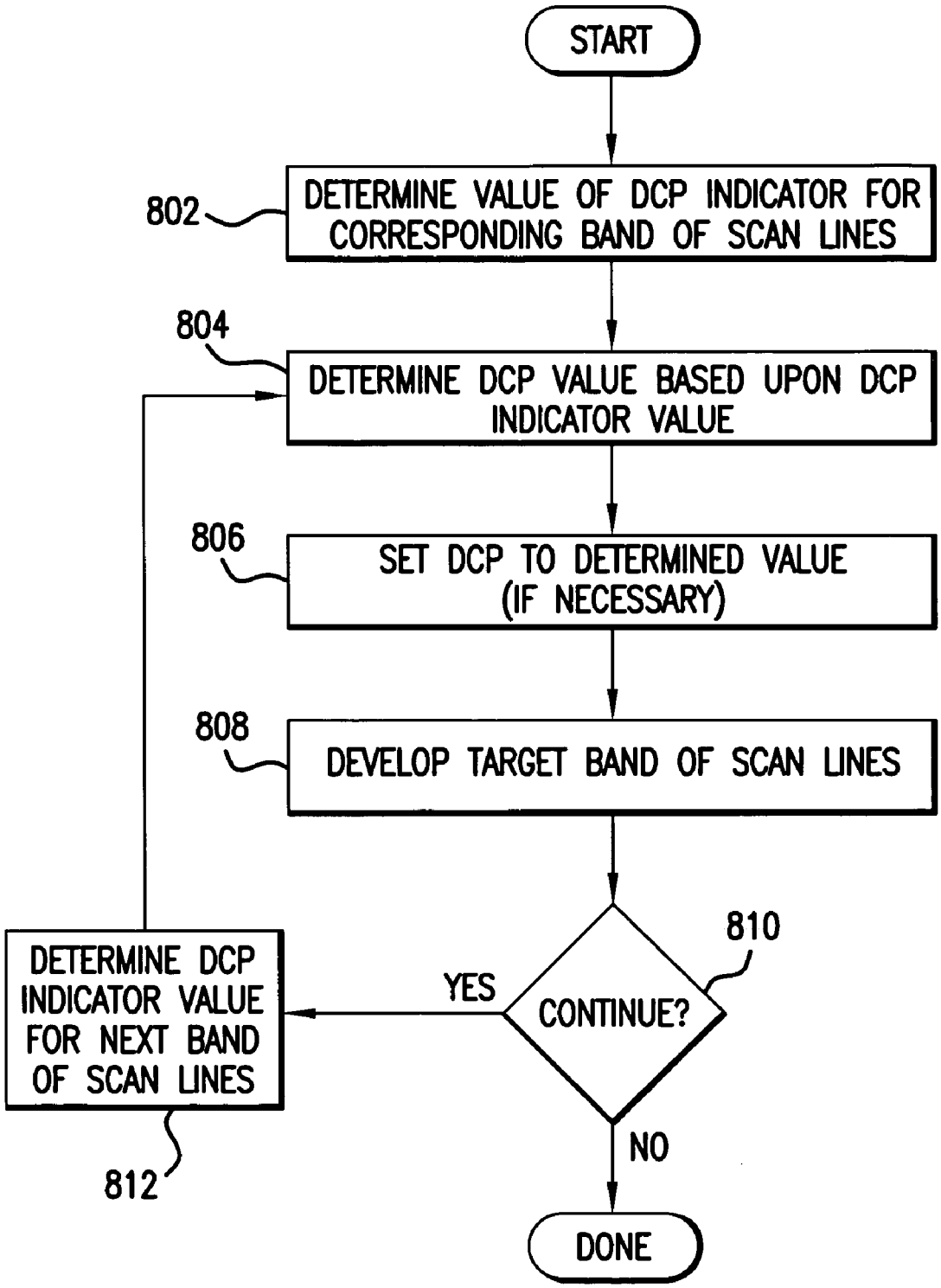
FIG. 8 is a flow diagram for further illustrating the operation of the print engine controller.

FIGS. 7–8 are flow diagrams for illustrating an aspect of the engine controller 205 functionality in response to the video data and the DCP indicators received from the formatter 202 for the image 602.

At block 702, the engine controller 205 causes the laser scanning unit 306 to scan the surface of the photoconductive drum 324 as dictated by the received video data. This results in a latent image that corresponds to the image 602 being produced on the surface of the photoconductive drum 324. Thus, the latent image comprises a first band of scan lines that correspond to image band #1, a second band of scan lines that correspond to image band #2, and a third band of scan lines that correspond to image band #3, and so on.

At block 704, the engine controller 205 controls the developer mechanism 320 to develop the latent image. At block 706 the engine controller 205 controls the print engine to perform the rest of the steps in the electrophotographic process so as to generate a printed page.

FIG. 8 illustrates a portion of the engine controller 205 operation at block 704 to develop the latent image. At block 802, the engine controller 205 determines the value of the DCP indicator (i.e., DCP indicator #1) for the target band of scan lines (i.e., the first band of scan lines) that is to be developed. Based upon this value and by using the look-up table, the engine controller 205 determines the AC bias parameter value (block 804).

At block 806, the engine controller 205 sets the AC bias parameter to the determined value. At block 808, the target band of scan lines is developed.

It is noted that the engine controller 205 may be configured to set the AC bias to the determined value at a pre-determined amount of time ("Δt_delay") prior to toner being transferred to the target band of scan lines. The value of "Δt_delay" may be selected to allow for delays in the response time of the print engine 204. For example, "Δt_delay" can be selected to allow for the AC bias to ramp to the desired AC bias value.

At block 812, the engine controller 205 determines the value of the DCP indicator for the next band of scan lines in the latent image and repeats the process just described to determine an AC bias parameter value for the band. If the AC bias value is different for this band, the engine controller 205 adjusts the AC bias value just prior to the development of this band. As before, the engine controller 205 may reset the AC bias at a pre-determined amount of time prior to toner actually being transferred to the band of scan lines.

The engine controller 205 continues the above described process until the latent image is developed.

Other Embodiments

Figure 9:
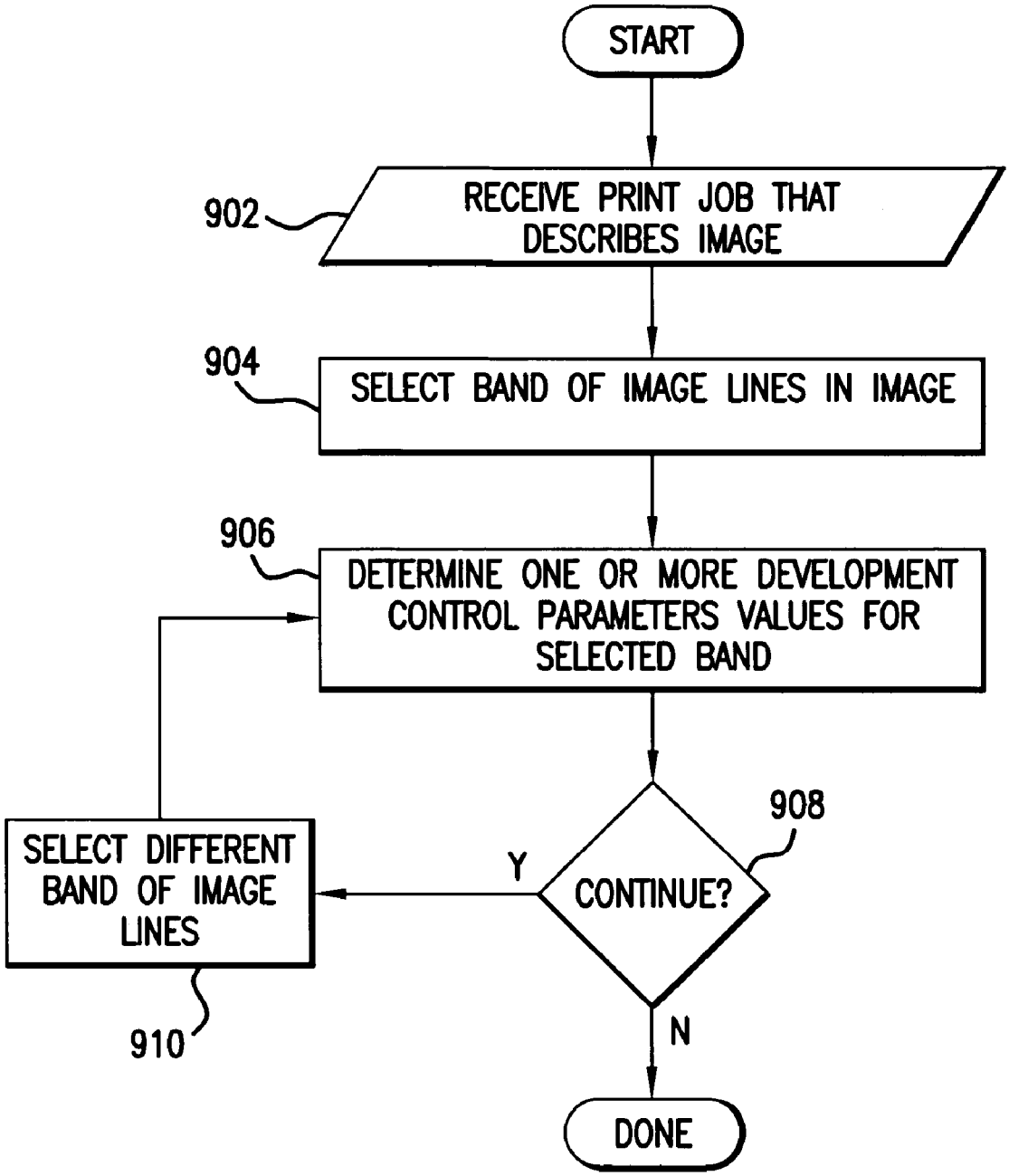
FIG. 9 is a process that may be performed by a laser printing device according to an embodiment of the invention.

FIG. 9 is a process that may be performed by a laser printing device according to another embodiment of the invention. It is assumed in the following discussion that the laser printing device includes a photoconductor and a developer mechanism.

Shown in FIG. 9, a print job is received by the printing device (block 902). At block 904 the printing device selects a band of image lines described by the job. At block 906, the printing device determines a set of development control parameter values (e.g., AC bias value, DC bias value and/or rotational velocity of a developer roller, etc.) for the selected band. In this embodiment, this determination is based upon whether or not a development area within the band is above a threshold size. As noted above, a "development area" refers to any area in the band that is to receive toner during toner development.

For example, the printing device may select a set of development control parameters at block 906 that cause a relatively high amount of toner to be transferred to the band (during band development) if any development area within the band is over a threshold area size. This can prevent under development of the band.

Furthermore, the printing device may select development control parameters that cause a relatively low amount of toner to be transferred to the band if any development area within the band is below the threshold area size. This can prevent over development of the band and prevent some or all of the problems described in the background.

At block 910, the printing device repeats the acts just described for the next band. The printing device may continue in this manner until a set of control parameter values are determined for each band of image lines in the image.

It is also noted that the present invention may be embodied in the form of a "computer-readable medium". As used herein, the phrase "computer-readable medium" can refer to any medium that can contain, store or propagate computer executable instructions. Thus, in this document, the phrase "computer-readable medium" may refer to a medium such as an optical storage device (e.g., a Compact Disc), a magnetic storage device (e.g., a magnetic tape), a semiconductor storage device, etc. The phrase "computer-readable medium" may also refer to signals that are used to propagate the computer executable instructions over a network or a network system, such as the Public Internet.

Thus, for example, the memory 214 and the memory 208 may each represent an embodiment of the invention. Also, signals used to propagate the firmware components stored in these memories also represent an embodiment of the invention.

Although several specific embodiments of the invention have been described and illustrated, the invention is not to be limited to specific forms or arrangements of parts so described and illustrated. For example, in one part of the description individual pixels are classified into one of plural image types (e.g., Text, Graphics and Raster). In other embodiments, an image type classification may be given to other types of image elements such as specific groups of pixels or to specific development areas in the image.

Additionally, in other parts of the description various development control parameter examples were described. These control parameters may be different for different types of print engines. In a printing device with toner suspended in a liquid, such as a digital printing press, a development control parameter may include a value of a flow rate of a developer fluid that is presented to a photoconductor, a rotational speed of a developer roller, etc. The invention is limited only by the claims and the equivalents thereof.

What is claimed is:

1. In an electrophotographic printing device, a method of determining a toner development control parameter comprising:

(a) receiving a print job that describes an image to be printed;

(b) determining if a band of image lines in the image satisfies pre-determined criteria; and (c) determining a development control parameter value based, at least in part, on whether the band is determined to satisfy the pre-determined criteria.

2. The method of claim 1, further comprising:

(d) scanning the surface of a photoconductor so as to produce a latent image, a portion of the latent image corresponding to the band;

(e) developing the latent image;

(f) maintaining the control parameter at the determined value while developing the portion of the latent image that corresponds to the band.

3. The method of claim 1, further comprising:

(d) repeating acts (b)–(c) for different bands in the image.

4. The method of claim 1, wherein the image segment contains image elements each classified as one of plural image types and act (b) includes:

(i) identifying an image type of each image element included in the band; and (ii) determining if the band satisfies the predetermined criteria based upon which image types are identified.

5. The method of claim 1, wherein the image includes a plurality of image elements each classified as one of Text, Graphic or Raster and act (b) includes:

determining if the band contains only image elements classified as Text.

6. The method of claim 1, further comprising:

(d) causing a latent image to be formed on a photoconductor, a portion of the latent image corresponding to the band of image lines;

(e) controlling a developer mechanism to transfer toner to the latent image;

(f) maintaining the control parameter at the determined value at least part of a time the developer mechanism is transferring toner to the portion of the latent image that corresponds to the band of image lines.

7. The method of claim 6, wherein the developer mechanism includes a developer roller and the control parameter value comprises a value selected from a group consisting of an AC bias applied to the developer roller, a DC bias applied to the developer roller and the rotational velocity of the developer roller.

8. The method of claim 6, wherein the developer mechanism is integrated in a replaceable toner cartridge.

9. The method of claim 1, wherein act (b) includes:

determining if a development area within the band is above a threshold size.

10. In a electrophotographic printing device, a method of processing a received print job that describes an image to be printed comprising:

(a) selecting a segment of the image;

(b) determining if the selected image segment satisfies pre-determined criteria;

(c) generating an indicator for the selected image segment, the indicator indicating whether the image segment satisfies the pre-determined criteria;

(d) transmitting video data that describes the image segment to a print engine controller; and (e) transmitting the indicator to the print engine controller, where the print engine controller uses the indicator to determine a control parameter value of a development mechanism; and (f) repeating acts (a)–(e) for different segments of the image.

11. The method of claim 10, wherein the method is performed by a formatter in the printing device.

12. The method of claim 10, wherein act (c) includes:

generating an indicator set to a first value if the selected image segment contains image elements of only one particular image type.

13. The method of claim 10, wherein the determining step is performed by analyzing only the characteristics of the selected image segment.

14. The method of claim 12, wherein the control parameter is selected from a group consisting of an AC bias, an AC bias frequency, an AC bias waveform, a DC bias and a developer roller rotational velocity.

15. An electrophotographic printing device, comprising:

(a) means for classifying data portions of a received data stream into one of plural image types, the data stream describing an image to be printed;

(b) means for determining the type of images contained in a segment of the image; and (c) means for establishing a control parameter value of a toner developer mechanism based, at least impart, upon the type of images contained in the image segment.

16. The printing device of claim 15, further comprising:

(d) means for forming a latent image on a surface of an photoconductor;

(e) means for controlling the developer mechanism to transfer toner to the latent image; and (f) means for setting the control parameter to the established value while the developer mechanism is transferring toner to a portion of the latent image that corresponds to the image segment.

17. The printing device of claim 16, wherein the plural image types comprise Text, Raster and Graphic.

18. One or more computer-readable media having computer readable instructions embodied thereon which, when executed by one or more processors in a printing device, cause the one or more processors to:

determine if a band of image lines in an image satisfies pre-determined criteria; and determine a development control parameter value of a developer mechanism based, at least in part, on whether the band is determined to satisfy the pre-determined criteria.

19. The one or more computer-readable media of claim 18, wherein the computer readable instructions further cause the one or more processors to:

set the development control parameter to the determined value; and control the developer mechanism to develop a band of scan lines in a latent image on a photoconductor; and wherein the band of scan lines correspond to the band of image lines.

20. The one or more computer-readable media of claim 18, wherein the computer readable instructions further cause the one or more processors to:

identify an image type of each image element included in the band; and determine whether the band satisfies the predetermined criteria based on which image types are identified.

21. One or more computer-readable media having computer readable instructions embodied thereon which, when executed by one or more processors in a printing device, cause the one or more processors to:

determine if a band of image lines in an image satisfies pre-determined criteria;

generate an indicator for the selected band, the indicator indicating whether the band satisfies the pre-determined criteria; and transmit the indicator to a print engine controller, where the print engine controller uses the indicator to determine a control parameter value of a development mechanism.

22. The one or more computer-readable media of claim 21, wherein the computer readable instructions cause the one or more processors to set the indicator to a first value if the band of image lines contain only Text type images.

23. The one or more computer-readable media of claim 22, wherein the computer readable instructions cause the one or more processors to set the indicator to a second value if the band of image lines contain Graphics or Raster type images.

* * * * *

UNITED STATES PATENT AND TRADEMARK OFFICE

CERTIFICATE OF CORRECTION

PATENT NO. : 7,020,406 B2
APPLICATION NO. : 10/769524
DATED : March 28, 2006
INVENTOR(S) : Richard L. Swantner It is certified that error appears in the above-identified patent and that said Letters Patent is hereby corrected as shown below:

On the title page, item (75), in "Inventor", in column 1, line 1, delete "Bois" and insert -- Boise --, therefor.

In column 9, line 31, in Claim 7, delete "the rotational velocity" and insert -- a rotational velocity --, therefor.

In column 10, line 8, in Claim 15, delete "impart" and insert -- in part --, therefor.

Signed and Sealed this

Eighteenth Day of August, 2009

David J. Kappos

David J. Kappos
*Director of the United States Patent and Trademark Office*